US005867828A

United States Patent [19]

Shih

[11] Patent Number: 5,867,828

[45] Date of Patent: Feb. 9, 1999

[54] WADERS AND THE METHOD FOR MANUFACTURING THEM

[75] Inventor: Liang-Kun Shih, Fengyuan, Taiwan

[73] Assignee: Pacific Eagle Enterprise Co., Ltd., Fengyuan, Taiwan

[21] Appl. No.: 57,365

[22] Filed: Apr. 8, 1998

[51] Int. Cl.[6] ..... A41D 13/00; A41D 1/06

[52] U.S. Cl. ..... 2/82; 2/227; 2/243.1

[58] Field of Search ..... 2/82, 81, 69, 79, 2/227, 243.1, 230, DIG. 1, DIG. 5; 36/4, 109

[56] References Cited

U.S. PATENT DOCUMENTS

| | | | |
|---|---|---|---|
| Re. 34,662 | 7/1994 | Keller | 2/82 |
| 5,022,096 | 6/1991 | Pacanowsky | 2/227 |
| 5,081,718 | 1/1992 | Carman et al. | 2/227 |
| 5,210,879 | 5/1993 | Miller | 2/82 |

OTHER PUBLICATIONS

Orvis, Spring Fishing & Outdoor 1995—Catalog, pp. 76–81 & 83.

*Primary Examiner*—Gloria Hale
*Attorney, Agent, or Firm*—Michael A. O'Neil

[57] ABSTRACT

A pair of waders includes a gas permeable layer having a first side and a second end, a water-proof film fixedly mounted on the first side of the gas permeable layer, an outer cover fixedly mounted on the water-proof film, and a lining fixedly mounted on the second side of the gas permeable layer.

12 Claims, 6 Drawing Sheets

WADERS AND THE METHOD FOR MANUFACTURING THEM

FIELD OF THE INVENTION

The present invention relates to waders, and more particularly to waders and the method for manufacturing them.

BACKGROUND OF THE INVENTION

A conventional pair of waders are shown in FIG. 6, and an illustration will follow in the detailed description of the preferred embodiments. The present invention has arisen to mitigate and/or obviate the disadvantage of the conventional fishing trousers.

SUMMARY OF THE INVENTION

In accordance with one aspect of the present invention, there is provided a pair of waders comprising a gas permeable layer including a first side and a second side, a water-proof film fixedly mounted on the first side of the gas permeable layer, an outer cover fixedly mounted on the water-proof film, and a lining fixedly mounted on the second side of the gas permeable layer.

In accordance with another aspect of the present invention, there is provided a method for manufacturing a pair of waders and comprising the steps of: (a) providing a lining, a gas permeable layer including a first side and a second side, a water-proof film, and an outer cover; (b) forming a plurality of vent holes through the gas permeable layer; (c) mounting the water-proof film on the first side of the gas permeable layer; (d) mounting the outer cover on the water-proof film; (e) mounting the lining on the second side of the gas permeable layer to form a laminated layer including the lining, the gas permeable layer, the water-proof film and the outer cover; (f) cutting the laminated layer so as to form a plurality of peripheral cut edges; (g) adhering the peripheral cut-edges of the laminated layer to form a semi-product of a pair of waders; and (h) sewing up the peripheral cut-edges of the laminated layer to form a product of the pair of waders.

Further features of the present invention will become apparent after a careful reading of the detailed description with appropriate reference to the accompanying drawings.

DETAILED DESCRIPTION OF THE PREFERRED EMBODIMENTS

Figure 6:
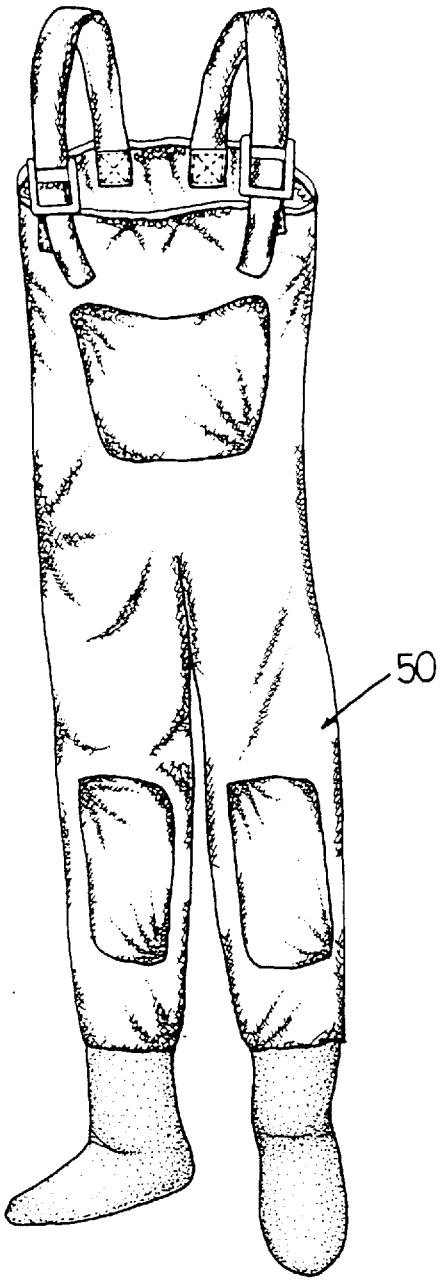
FIG. 6 PRIOR ART
FIG. 6 is a perspective view of a conventional pair of waders in accordance with the prior art.

For a better understanding of features and benefits of the present invention, reference is now made to FIG. 6, illustrating a conventional pair of waders 50 in accordance with the prior art. The conventional waders 50 are water-proof and can be adapted to suit a fisherman, a yachtsman, etc, thereby preventing the wearer's trunk and legs from getting wet. However, the conventional waders 50 are impermeable to gas such that they cannot provide a ventilating effect to the wearer, thereby easily causing an uncomfortable sensation due to moisture accumulating therein. In addition, the conventional waders 50 are heavy, thereby causing an inconvenience to the wearer.

Figure 1:
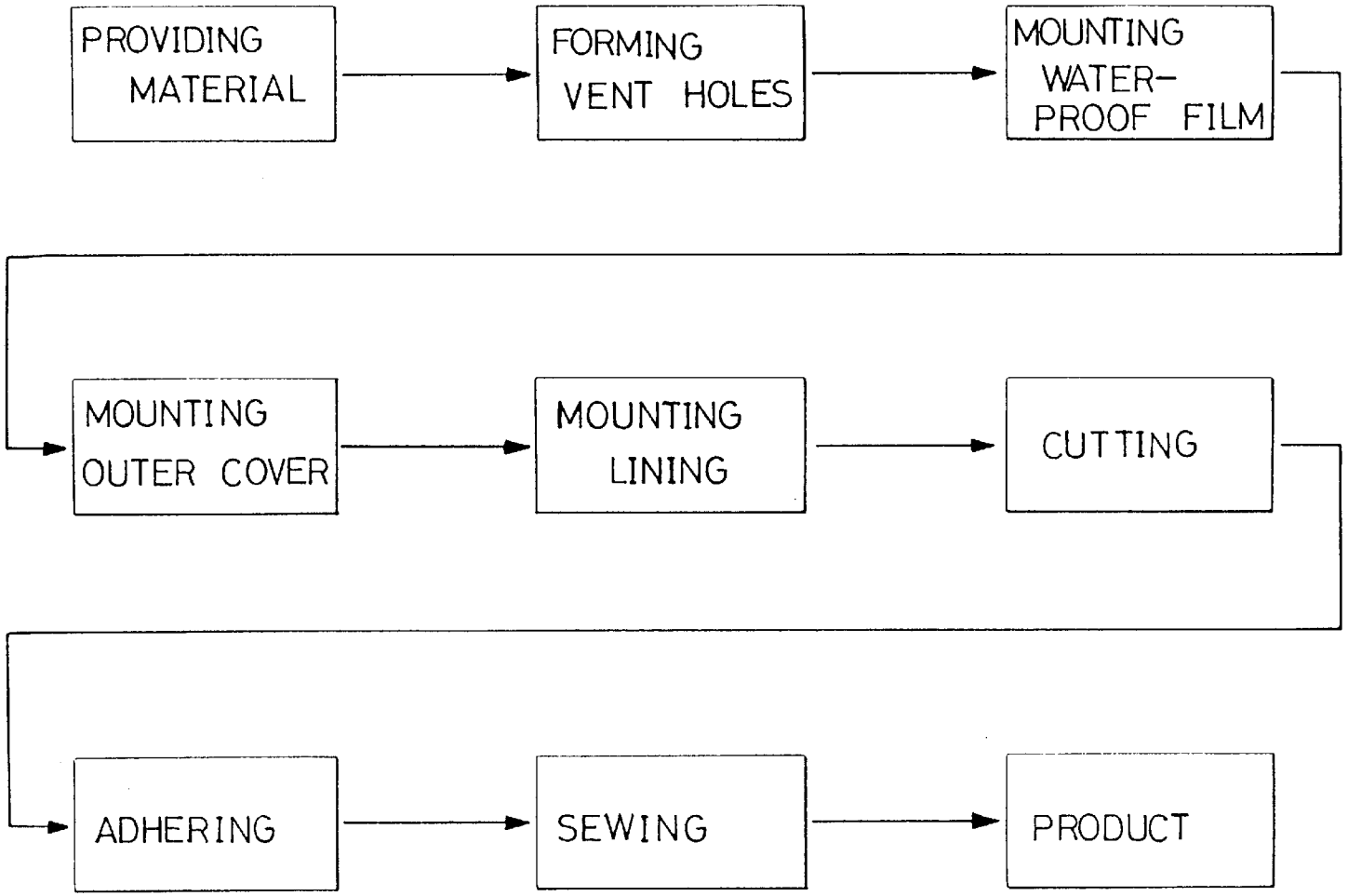
FIG. 1 is a flow chart of a method for manufacturing a pair of waders in accordance with the present invention.
Figure 2:
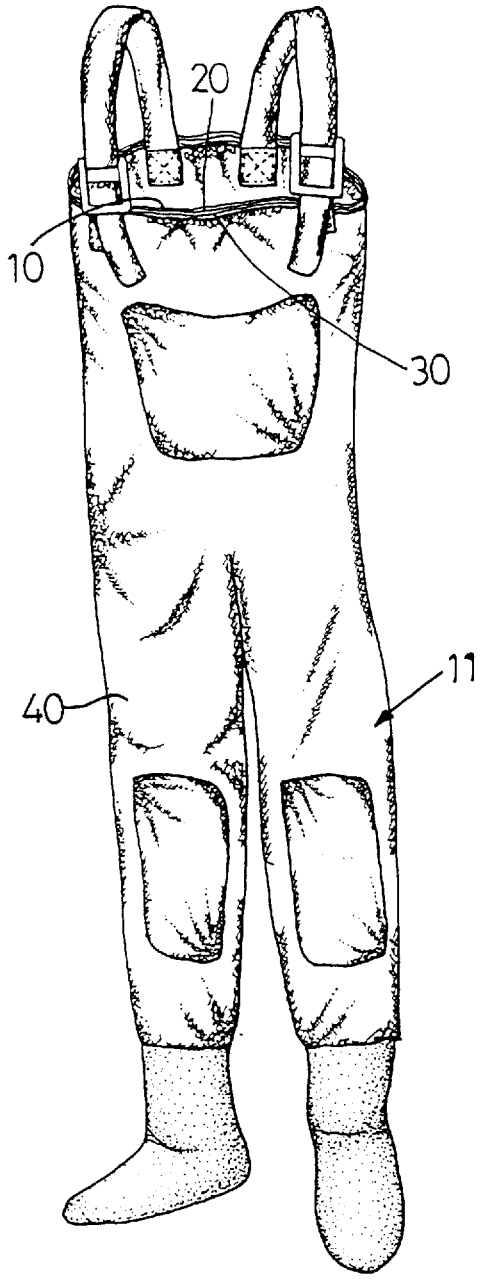
FIG. 2 is a perspective view of the waders in accordance with the present invention.
Figure 3:
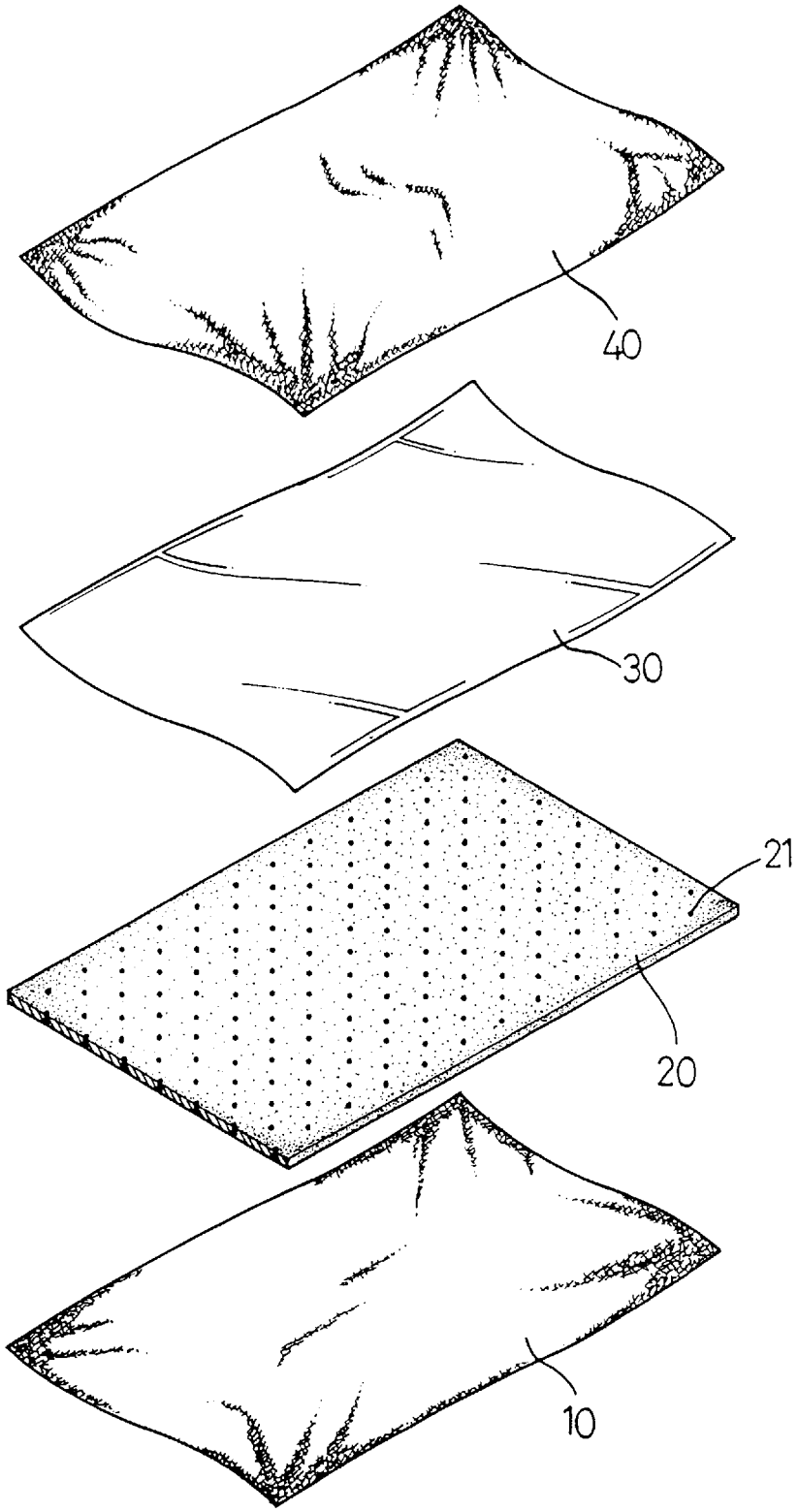
FIG. 3 is a partially exploded view of the waders shown in FIG. 2.
Figure 4:
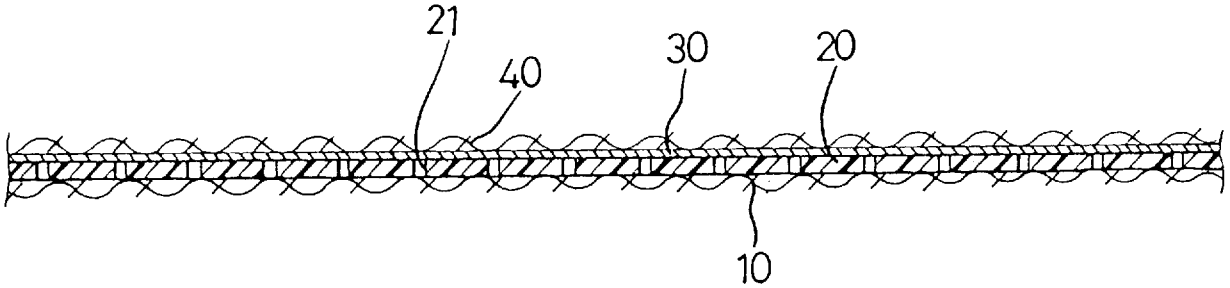
FIG. 4 is a front plan cross-sectional assembly view of the waders shown in FIG. 3.

Referring to the remaining drawings, and initially to FIGS. 2–4, a pair of waders 1 according to the present invention comprises a gas permeable layer 20 including a first side and a second side, a water-proof film 30 fixedly mounted on the first side of the gas permeable layer 20, an outer cover 40 fixedly mounted on the water-proof film 30, and a lining 10 fixedly mounted on the second side of the gas permeable layer 20.

The gas permeable layer 20 is made of foamable material or synthetic rubber and defines a plurality of vent holes 21 therethrough. The water-proof film 30 is preferably made of polyurethane (P.U.). The outer cover 40 and the lining 10 are made of nylon cloth respectively.

In operation, a person can put on the waders 1 with the lining 10 directly contacting or her skin and with the outer cover 40 exposed to surroundings. In such a manner, the gas permeable layer 20 can be adapted to provide a ventilating effect to the wearer by means of the vent holes 21, thereby incurring a comfortable sensation.

In addition, the water-proof film 30 can be adapted to efficiently to prevent water from entering and wetting the lining 10 via the vent holes 21, thereby achieving a water-proof function.

Referring now to FIGS. 1–5, a method in accordance with the present invention can be adapted for manufacturing a pair of waders 1 and comprises the following steps.

First of all, the lining 10, the gas permeable layer 20 including the first side and a second side, the water-proof film 30, and the outer cover 40 are initially selected, wherein the gas permeable layer 20 is made of foamable material or synthetic rubber, the water-proof film 30 is made of polyurethane (P.U.), the outer cover 40 and the lining 10 are made of nylon cloth respectively.

Secondly, the plurality of vent holes 21 is defined through the gas permeable layer 20 by means of such as a punching machine. Then, the water-proof film 30 can be mounted on the first side of the gas permeable layer 20 by means of such as adhesion.

Figure 5:
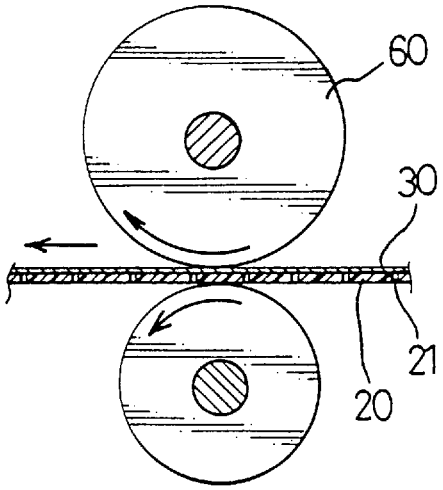
FIG. 5 is a front plan partially cross-sectional view showing two heating rolls for coupling a gas permeable layer and a water-proof film.

Preferably, the gas permeable layer 20 together with the water-proof film 30 can be conveyed to be heated and pressurized between a pair of heating rolls 60 as shown in FIG. 5 such that the water-proof film 30 can be tightly adhered on the first side of the gas permeable layer 20. The heating temperature for heating the gas permeable layer 20 together with the water-proof film 30 ranges between 110° C. and 130° C.

Then, the outer cover 40 can be mounted on the water-proof film 30 by means of such as adhesion, and the lining 10 can be mounted on the second side of the gas permeable layer 20 by means of such as adhesion, thereby forming a laminated layer including the lining 10, the gas permeable layer 20, the water-proof film 30 and the outer cover 40.

The laminated layer can then be cut according to the shape of the waders 1 so as to form a plurality of peripheral cut edges. The peripheral cut edges of the laminating layer can then be adhered together to form a semi-product of the waders 1.

Finally, the peripheral cut edges of the laminated layer can be sewed, thereby forming a product of the pair of waders 1 as shown in FIG. 4.

It should be clear to those skilled in the art that further embodiments may be made without departing from the scope and spirit of the present invention.

What is claimed is:

1. A pair of waders comprising:

a gas permeable layer (20) including a first side and a second side;

a water-proof film (30) fixedly mounted on said first side of said gas permeable layer (20);

an outer cover (40) fixedly mounted on said water-proof film (30); and a lining (10) fixedly mounted on said second side of said gas permeable layer (20).

2. The waders in accordance with claim 1, wherein said gas permeable layer (20) defines a plurality of vent holes (21) therethrough.

3. The waders in accordance with claim 1, wherein said gas permeable layer (20) is made of foamable material.

4. The waders in accordance with claim 1, wherein said gas permeable layer (20) is made of synthetic rubber.

5. The waders in accordance with claim 1, wherein said water-proof film (30) is made of polyurethane.

6. The waders in accordance with claim 1, wherein said outer cover (40) is made of nylon cloth.

7. The waders in accordance with claim 1, wherein said lining (10) is made of nylon cloth.

8. A method for manufacturing a pair of waders and comprising the steps of:

(a) providing a lining (10), a gas permeable layer (20) including a first side and a second side, a water-proof film (30), and an outer cover (40);

(b) forming a plurality of vent holes (21) through said gas permeable layer (20);

(c) mounting said water-proof film (30) on said first side of said gas permeable layer (20);

(d) mounting said outer cover (40) on said water-proof film (30);

(e) mounting said lining (10) on said second side of said gas permeable layer (20) to form a laminated layer including said lining (10), said gas permeable layer (20), said water-proof film (30) and said outer cover (40);

(f) cutting said laminated layer so as to form a plurality of peripheral cut edges;

(g) adhering said peripheral cutting edges of said laminated layer to form a semi-product of a pair of waders; and (h) sewing up said peripheral cut edges of said laminated layer to form a product of said pair of waders.

9. The method in accordance with claim 8, wherein said gas permeable layer (20) is made of foamable material.

10. The method in accordance with claim 8, wherein said gas permeable layer (20) is made of synthetic rubber.

11. The method in accordance with claim 8, after said step (c) further comprising the steps of:

providing a pair of a heating rolls (60); and conveying said gas permeable layer (20) together with said water-proof film (30) to be heated and pressurized between said pair of heating rolls (60).

12. The method in accordance with claim 11, wherein the heating temperature for heating said gas permeable layer (20) together with said water-proof film (30) ranges between 110° C. and 130° C.

* * * * *